US005286211A

United States Patent [19]

McIntosh

[11] Patent Number: 5,286,211

[45] Date of Patent: Feb. 15, 1994

[54] GROUND CONNECTOR

[75] Inventor: Glen D. P. McIntosh, Scarborough, Canada

[73] Assignee: The Whitaker Corporation, Wilmington, Del.

[21] Appl. No.: 11,021

[22] Filed: Jan. 29, 1993

[51] Int. Cl.[5] ..... H01R 4/30

[52] U.S. Cl. ..... 439/100; 439/803; 24/486; 269/87.3; 269/249

[58] Field of Search ..... 439/100, 792, 803; 403/400; 24/335, 486; 269/87.2, 87.3, 249

[56] References Cited

U.S. PATENT DOCUMENTS

| | | | |
|---|---|---|---|
| 2,151,524 | 3/1939 | Pittman et al. | 439/792 |
| 3,622,946 | 11/1971 | Rogers | 439/475 |
| 3,892,455 | 7/1975 | Sotolongo | 439/100 |
| 4,105,272 | 8/1978 | West et al. | 439/100 |
| 4,189,198 | 2/1980 | Reichman | 439/100 |
| 4,294,561 | 10/1982 | Chapman et al. | 403/400 |
| 4,643,512 | 2/1987 | Prodel | 439/475 |
| 4,863,390 | 9/1989 | Cera et al. | 439/100 |

OTHER PUBLICATIONS

A photocopy of p. 158 of a Thomas & Betts Corporation product catalog-believed to have been published Jan. 1991, showing a "New signal reference grid clamp".

*Primary Examiner*—Gary F. Paumen

*Attorney, Agent, or Firm*—Driscoll A. Nina, Jr.

[57] ABSTRACT

A connector for connecting a signal reference grid conductor to a support post. The connector includes a body member having a first end profiled to receive the post within a seat and a plurality of recesses disposed along the seat for receiving the conductors. A clamping mechanism exerts a force against the post so that the post is positively seated against the conductors contained in the recesses.

19 Claims, 7 Drawing Sheets

GROUND CONNECTOR

FIELD OF THE INVENTION

This invention relates to a device for connecting a ground conductor to a post.

BACKGROUND OF THE INVENTION

A raised sub-floor, constructed on posts or pedestals above the true floor of a structure, is a common design feature in computer room installations. This feature enables the cables and conduits of the electrical power distribution network and the assorted system interconnections to be located out of the way of the equipment operators. The raised sub-floor is becoming more common in conventional office space due to the automation of the modern office.

A proper ground is essential for both the equipment and the power distribution network to insure proper operation of the electronic devices and protect the operators. The equipment grounds and the power distribution ground must be interconnected to assure that there is no difference in electrical potential between components. This interconnection typically occurs beneath the raised sub-floor.

Safety regulations in the United States National Electrical Code (NEC) and the Canadian Electrical Code (CEC) require that all non-current carrying metal parts in these installations be grounded. It is convenient to establish a signal reference grid of crossing conductors beneath the raised sub-floor that incorporates the posts of the raised sub-floor to establish multiple conducting paths to ground. The grid assures that there is no voltage difference across the floor and that the floor has an impedance to ground that does not inhibit the flow of fault current. The low impedance to ground enables the grid to attenuate high-frequency noise which might effect electronic data transmission, ground the power distribution system to minimize the effects of noise from the power distribution system on the Automatic Data Processing (ADP) equipment and ground the capacitance charge, such as static electricity, present in the environment of the installation.

Because conductors of the signal reference grid typically cross at locations corresponding to the posts of the raised sub-floor, it would be helpful to have a single connector that is capable of fastening a plurality of conductors to a post without requiring the path of the conductor to be substantially altered. In addition, the connector should be: inexpensive; simple to install; usable over a range of conductor sizes and compatible with a range of post sizes and shapes.

SUMMARY OF THE INVENTION

According to the present invention, a ground connector is provided for connecting a conductor to a post that crosses the path of the conductor. A specific application being the interconnection of a conductor of a signal reference grid to a post or pedestal used to support a sub-floor of a computer room or office installation.

The present invention is a ground connector having a body with a first end portion and a second end portion joined by a middle portion. The first end portion has an inner surface that defines a seat for receiving the post. Incorporated into this inner surface, along the seat, are a plurality of recesses for selectively receiving the conductor, thereby enabling the post within the seat to be pressed against the conductors forming an electrical connection. Also included is a clamping mechanism that is movable between an engaged position where the post is held tightly in the seat and against the conductor and a disengaged position where the connector may be placed on, or removed from, the post.

It is an object of this invention to provide a connector for connecting a conductor to a post and in particular a conductor of a signal reference grid to a crossing post. It is another object of this invention to provide a connector that does not require the conductor to substantially deviate from its natural path within the grid in order to be connected to the post. It is yet another object of this invention to provide a connector that can maintain a tight connection between the conductor and the post over time.

It is a feature of this invention to have a body with a first end portion with an inner surface that defines a seat, for receiving the post, which includes a plurality of recesses formed in the inner surface along the seat that are adapted to selectively receive the conductor and position the conductor so that the post may be pressed tightly thereagainst by a clamping mechanism to establish the electrical connection. It is another feature of this invention that the inner surface of the seat includes a base jaw and a back-up jaw having the recesses therealong and defining an angle therebetween that corresponds to the angle formed by crossing conductors. It is yet another feature of this invention that the clamping mechanism may act along a line that bisects the angle between the two jaws to aid in aligning and securing the mating components as the post is pressed into the seat and against the conductor.

It is an advantage of this invention that it may be used with a variety of different post sizes and a variety of different post cross-sectional configurations. It is another advantage of this invention that it is usable with a range of different conductor sizes.

DETAILED DESCRIPTION OF THE INVENTION

Figure 6:
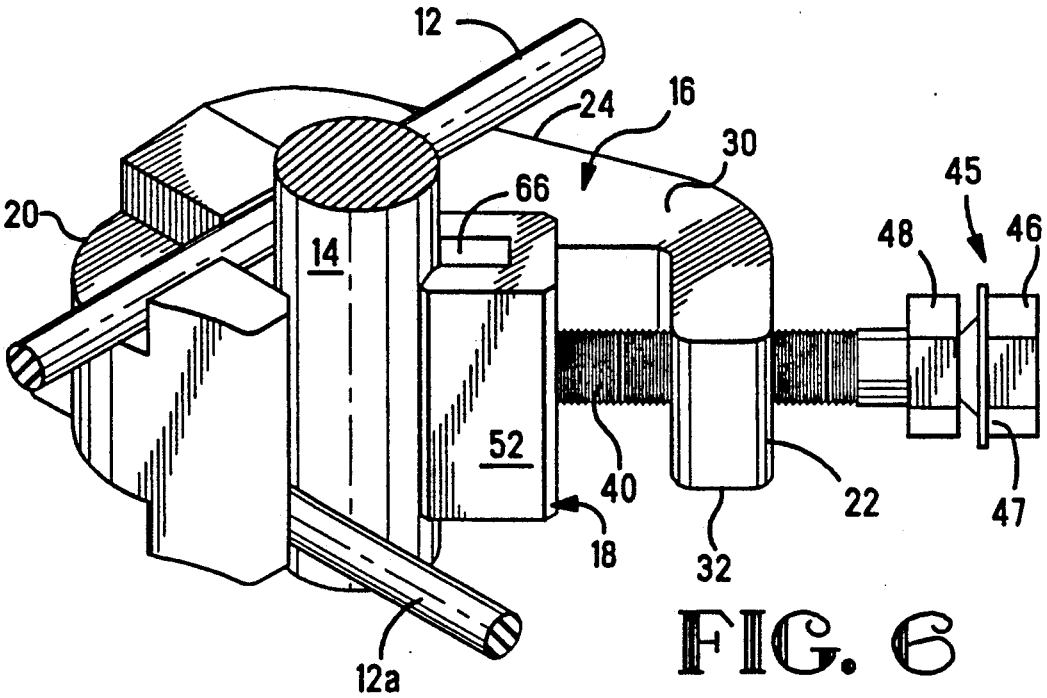
FIG. 6 is a perspective view of the connector showing crossing conductors connected to a round post.
Figure 7:
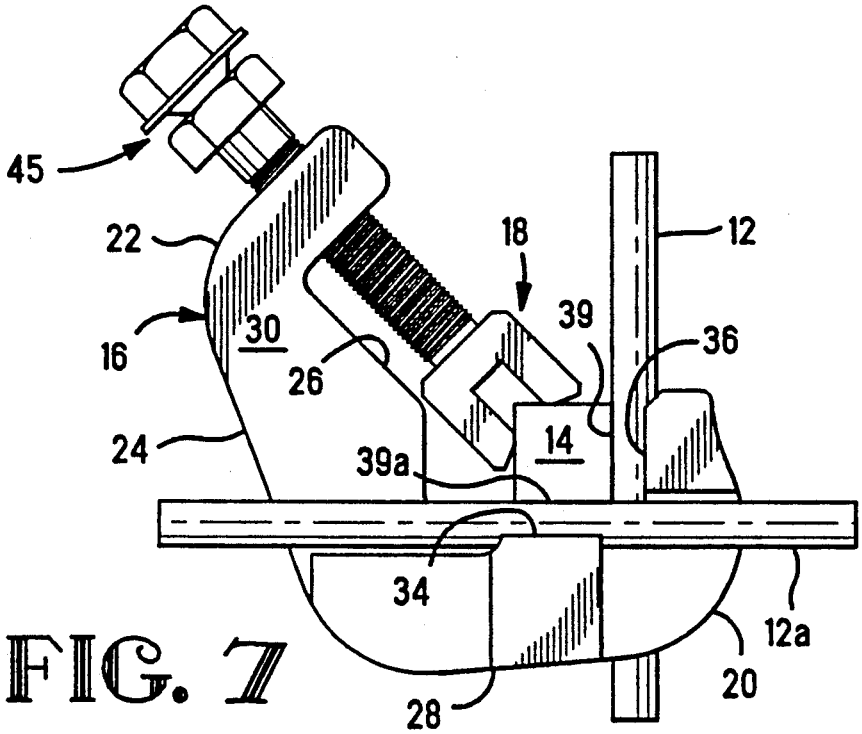
FIG. 7 is a top view of the connector showing crossing conductors connected to a square post.
Figure 8:
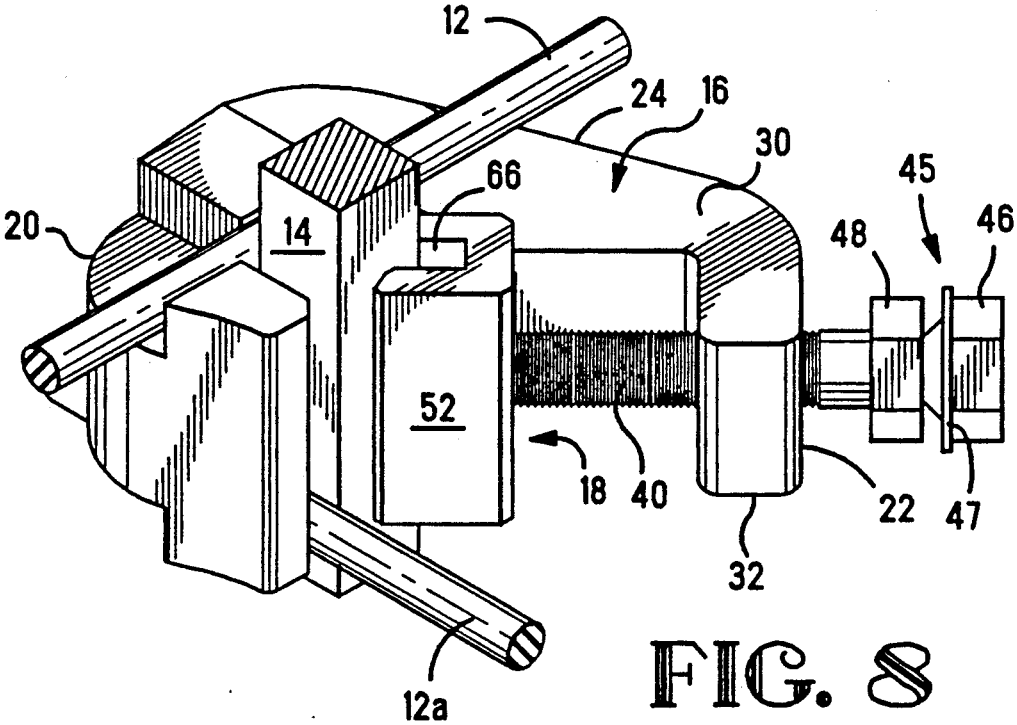
FIG. 8 is a perspective view of the connector showing crossing conductors connected to a square post.

The drawings show a signal reference grid connector 10 for connecting a conductor 12 to a post 14. The post 14 may be a pedestal or support post of a raised sub-floor installation (not shown), in which case the post 14 will be orientated vertically, and the conductor 12 may be part of a signal reference grid (not shown) installed horizontally beneath the raised sub-floor. It is possible to use the connector 10 with a post 14 having a round cross section, as shown in FIGS. 6 and 7, or a polygonal cross-section as illustrated by, but not limited to a square cross-section shown in FIGS. 7 and 8.

The connector 10 comprises a body 16 and a clamping mechanism 18. The body 16 includes a first end portion 20 and a second end portion 22 joined by a middle portion 24, whereby a generally C-shaped member is formed. The proportions of the body 16 are selected so that when connector 10 is installed on a post 14, the body acts as a spring and elastically deflects storing a residual force to cope with any relaxation of the conductors 12 or the connector 10. Extending along these portions 20–24 are an inner surface 26, an outer surface 28 and upper and lower side surfaces 30,32.

It is presently envisioned that the body will be cast of an aluminum alloy and have smooth blend radii throughout. The drawings do not include these radii to better illustrate the body 16. It would be possible to manufacture the connector body from other conductive materials and to use other manufacturing methods, such as machining or forging. It is also envisioned that a plating, such as tin, may be deposited on the connector 10 to enhance corrosion resistance. Because the post is conductive, it is not necessary that the connector body 16 also be made from a conductive material. A conductive path between the crossing conductors 12, 12*a* will be established through the post 14 rather than through the connector body 16. Therefore, the connector body 16 may be made from a plastic or another dielectric compound.

The first end portion 20 is profiled to receive the post 14 within a seat 22 defined by the inner surface 26. The seat 22 includes a base jaw 34 and a back-up jaw 36. These jaws 34,36 are approximately square to each other and capable of seating both round and polygonal posts 14 as discussed above.

The range of sizes of posts 14 that the connector 10 can accept is dependent on the size of the seat 22, which is dependent on the size of the jaws 34,36. This dependency is readily observable by examining the drawings and the discussion below. The connector 10 is capable of accommodating square posts ranging in size from ¾ inches to ⅞ inches and 1 inch round posts.

Incorporated into each of the jaws 34,36 are a pair of recesses 38,38*a* that extend along the upper side surface 30 and the lower side surface 32, respectively. These recesses 38 are partial cylindrical indentations. The depth and the size of the recess 38 determines the size of the conductor 12 that the connector 10 can accommodate. The depth of the recesses 38 must be sufficiently shallow to expose enough of the conductor 12 above the inner surface 26 along the jaw so that the post 14 can be tightly pressed thereagainst. Signal reference grids may be formed with No. 4 AWG (American Wire Gage) to No. 8 AWG wire. It would also be possible to have deeper recesses 38 and incorporate projections that extend from the surface of the post 14 to engage the conductor 12.

Figure 1:
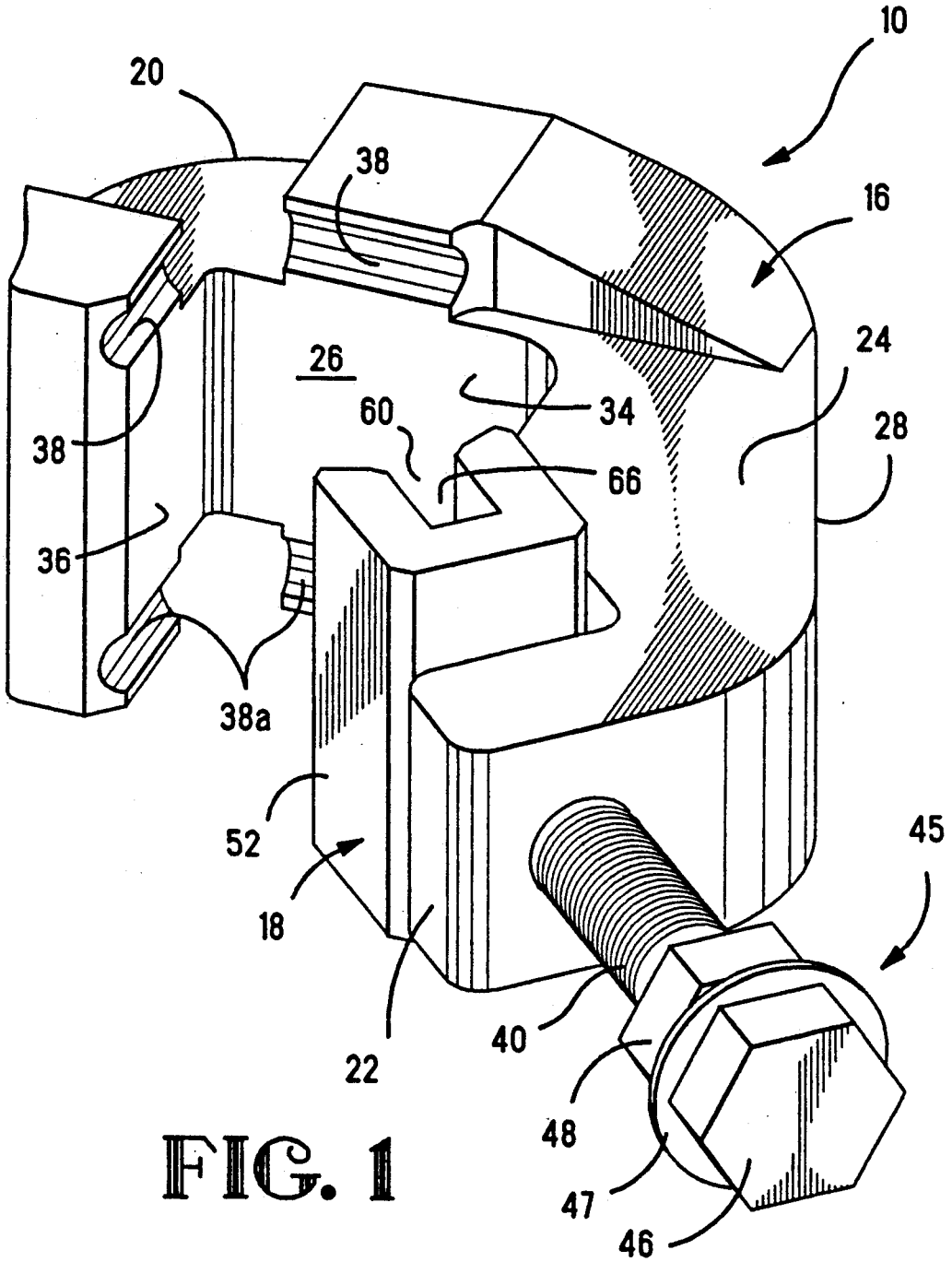
FIG. 1 is a perspective view of the connector.
Figure 2:
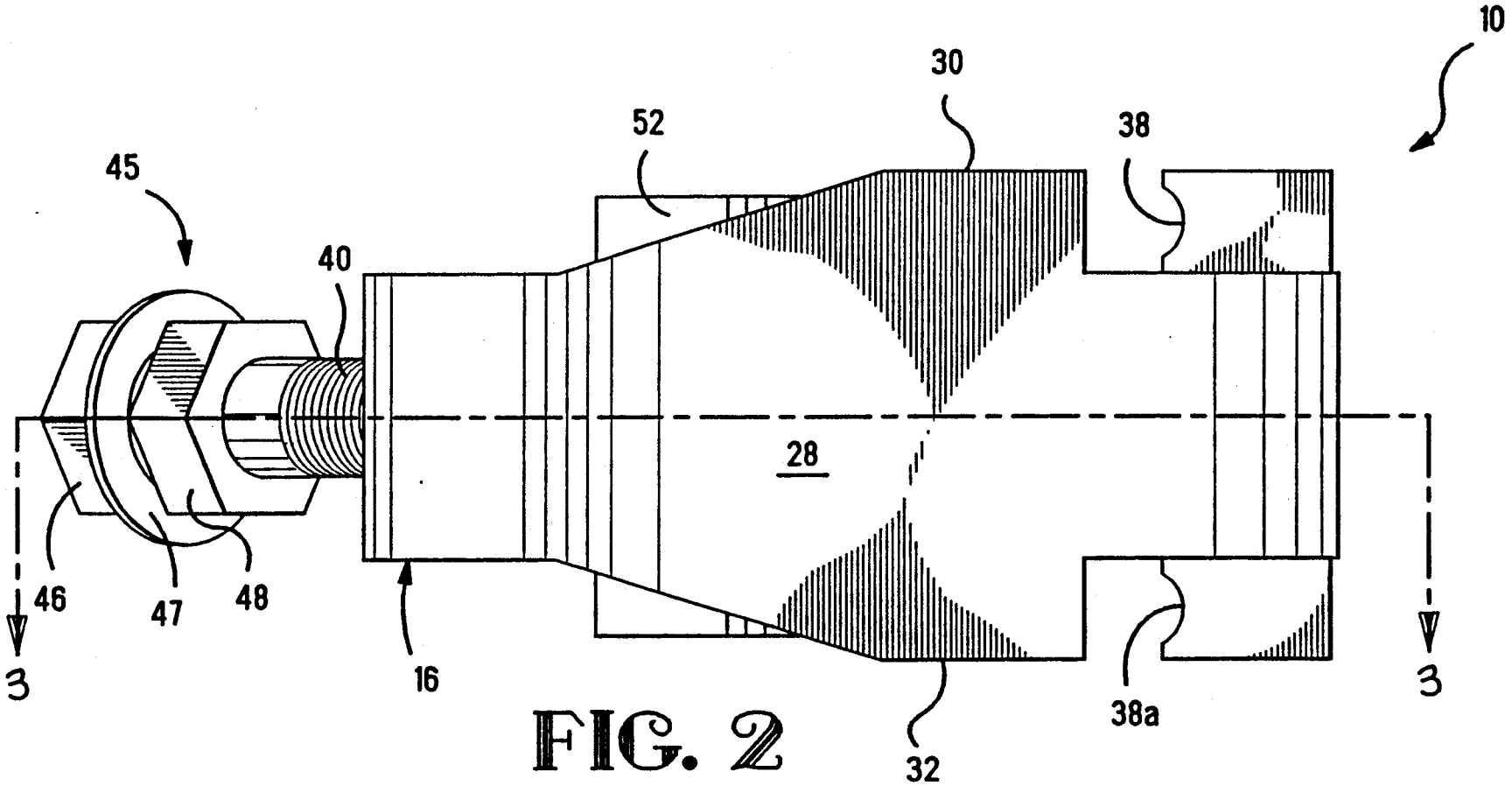
FIG. 2 is a rear side view of the connector.
Figure 3:
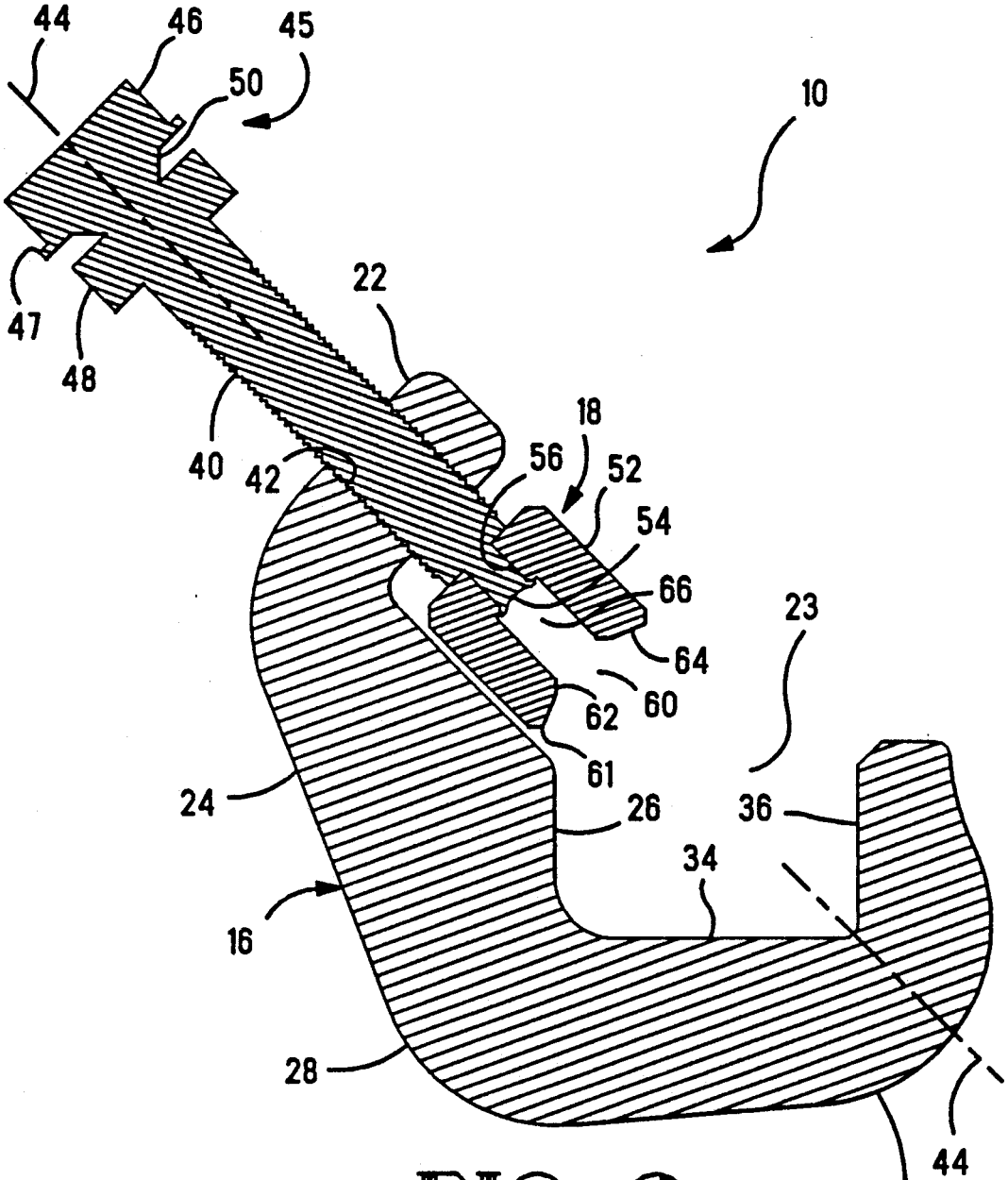
FIG. 3 is a cut-away view of the connector along line 3—3 of FIG. 2.
Figure 4:
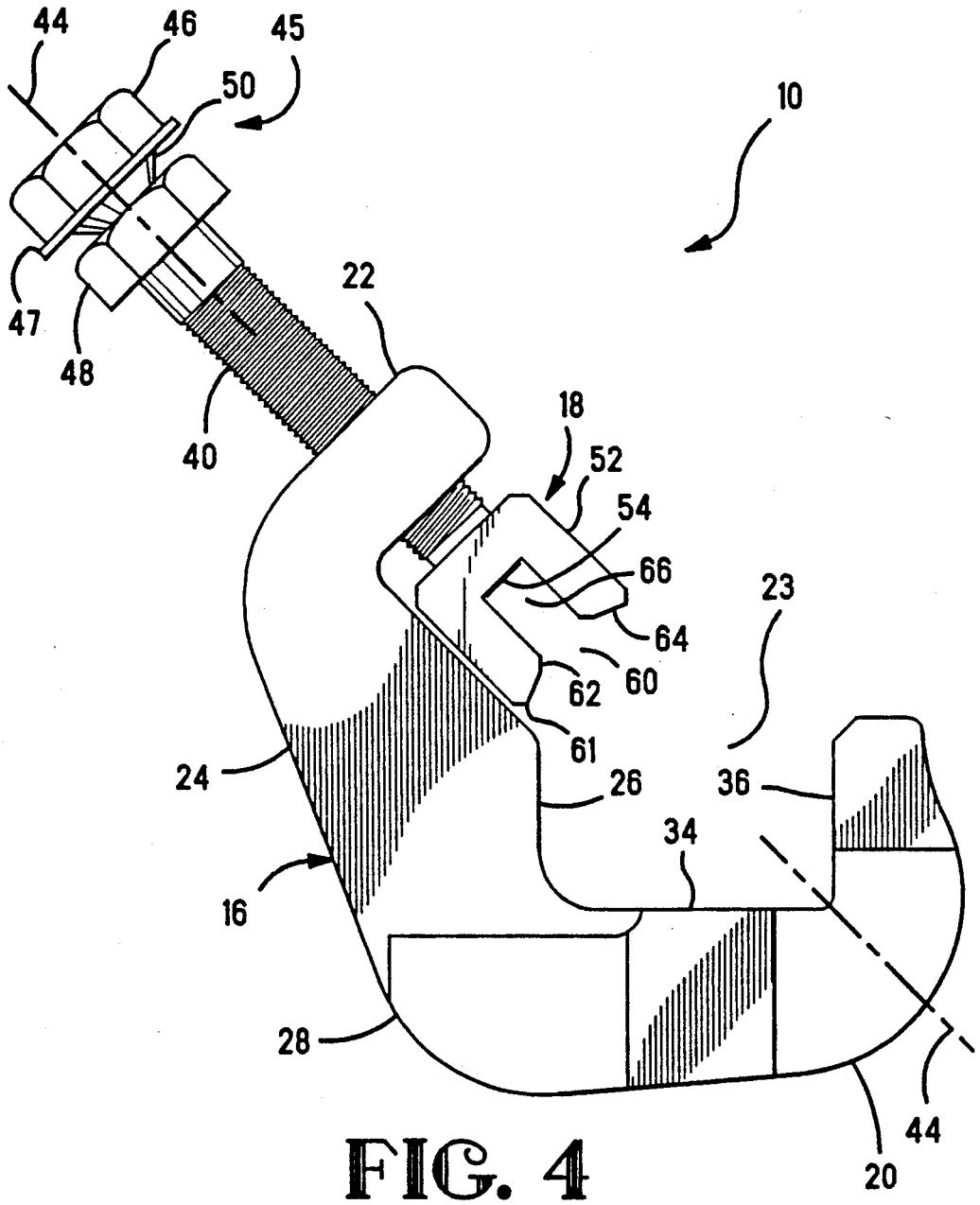
FIG. 4 is top view of the connector.
Figure 5:
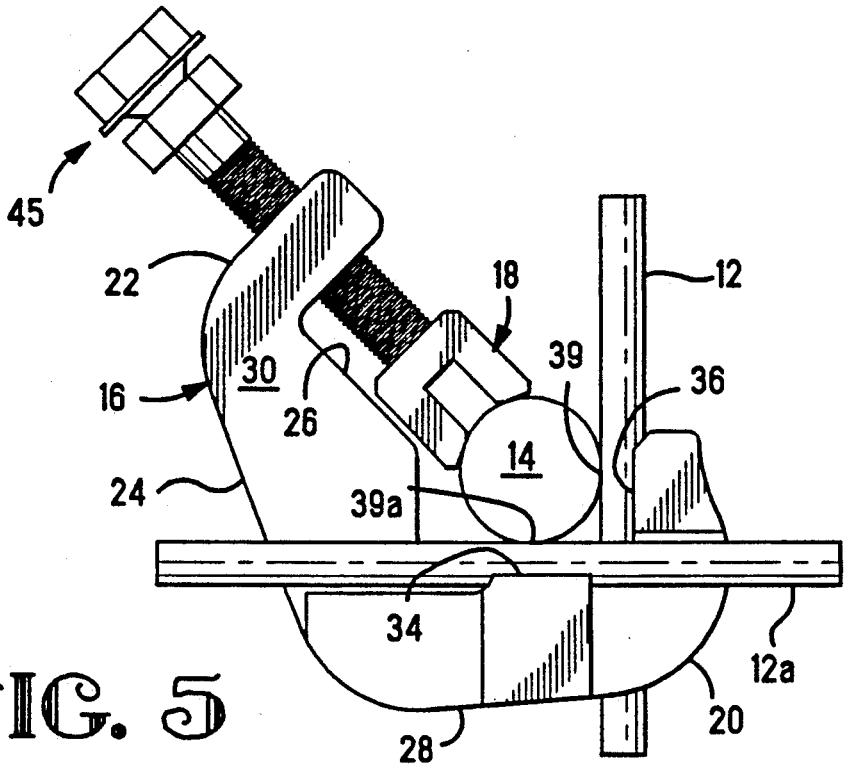
FIG. 5 is a top view of the connector showing crossing conductors connected to a round post.

In addition to the depth of the recess 38 being a controlling factor as to the range of conductor 12 sizes the connector 10 may accommodate, the distance that the recess extends along the jaw 34,36 determines the range of post 14 sizes and post configurations that the connector 10 can accept. The recesses 38,38*a* must span the point of contact 39 between the posts 14 and the conductors 12 where the post 14 has a cross-sectional configuration that would produce a single point of contact 39, such as is shown in FIG. 5. If the post has a square cross section, a line of contact 39*a* is established and the recesses must span this line a sufficient distance to positively hold the post and conductor against each other.

Signal reference grids most commonly involve conductors 12,12*a* that cross at 90 degree angles. A feature of the present invention is that the conductors 12,12*a* may be connected with the post 14 without having significant deviation from their natural orientation. As shown in the drawings, the jaws 34,36 are orientated approximately square to each other corresponding to the paths of the conductors 12,12*a* in the grid, thereby enabling the conductors 12,12*a* to be interconnected with the post 14 without requiring substantial deviation from their natural path. By not altering the path of the conductors the amount of conductor material needed to form the grid and the installation time is minimized. It is possible to apply this invention to grids where the conductors 12,12*a* cross at an angle other than 90 degrees by creating a connector 10 that has the angular relationship between the jaws 34,36, and therefore the recesses 38,38*a*, corresponding to the angle at which the grid conductors 12,12*a* cross.

Figure 9:
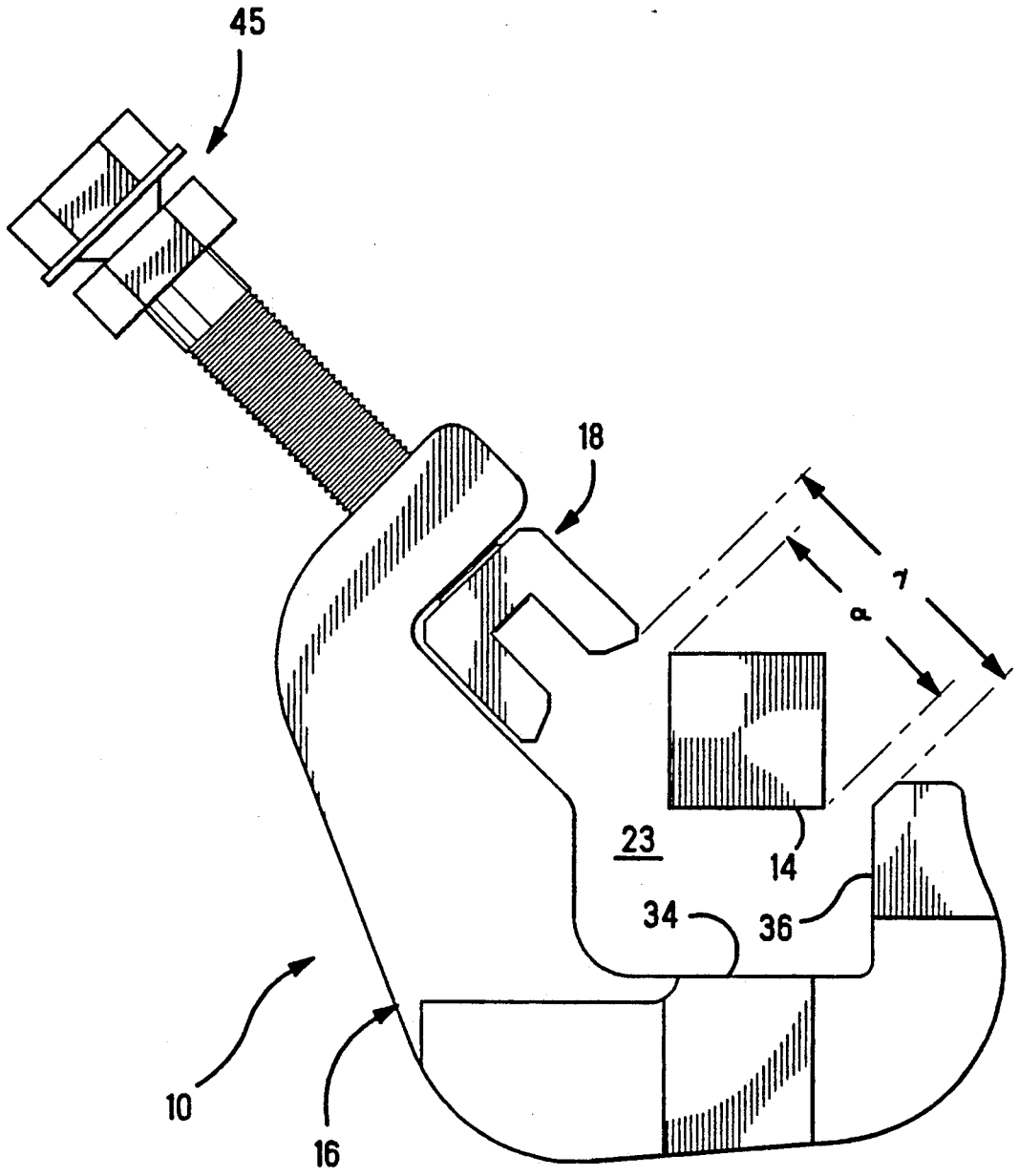
FIG. 9 is a top view of the connector in the disengaged position with a square post.

A clamping mechanism 18 is employed to hold the post 14 against the conductors 12. The clamping mechanism 18 includes a clamp tightening screw 40 within a threaded bore 42 that passes through the inner 26 and outer 28 surfaces at the second end portion 22 of the body 16. The clamping mechanism 18 has an engaged position, shown in FIGS. 5–8, where the post 14 is being held tightly in the seat 22 and against the conductors 12. The clamping mechanism 18 also has a disengaged position, as shown in FIG. 9, where the clamping mechanism 18 is retracted towards the second end portion 22 of the body 16. In the disengaged position, the post 14 is side-accessible to the connector 10 enabling the connector 10 to be installed on the post 14 when the ends of the post 14 are no longer accessible.

Ideally, the clamping mechanism acts along a line 44 that bisects the angle defined between the two jaws 34,36. By acting along this line 44, the force exerted by the clamping mechanism 18 will tend to align the body 16, the post 14 and the conductors 12 as the clamping mechanism 18 is tightened to effect the most secure engagement of the connector 10 to the post 14 and therefore the post 14 against the conductor 12.

The clamp tightening screw 40 can be adapted to limit the amount of compression the clamping mechanism 18 can produce, thereby protecting the post 14, conductors 12,12*a* and the connector 10 from damage due to over-tightening by incorporating a shear-head 45 into the clamp tightening screw 40. The shear-head 45 has a first head 46 and a second head 48 separated from each other by an undercut 50 extending into the screw 40. By adjusting the depth of the undercut 50 the amount of force exerted on the post 14 can be controlled. An undercut 50 is selected that allows the first head 46 to shear from the screw 40 when the amount of torque on the first head 46 exceeds the amount of torque required to produce the desired compressive force. The two heads 46,48 are aligned and a lip 47, where the first head 46 meets the undercut 50, prevents a wrench socket from also engaging the second head 48. This could also be accomplished by placing a C-clip in the undercut or by offsetting the heads 46,48 relative to each other. The second head 48 remains on the screw 40 for disassembly.

The shear-head 45 provides a convenient way of assuring clamping does not damage the post while still exerting the necessary amount of force to establish the electrical connection. It also assures that the force necessary to deflect the body upon tightening, but not enough to exceed the elastic limits of the material, is exerted during clamping. This deflection stores energy within the body 16 which acts as a residual force to accommodate any relaxation of the conductor 12 or the clamping mechanism 18 in order to maintain the connector 10 in tight engagement with the conductor 12 and the connection. The connector 10 may be used with the second head 48 intact by using a torque wrench or an equivalent device.

In order to increase clamping effectiveness a clamp block 52 may be incorporated on the end of the clamping screw 40. The clamp block 52 acts to distribute the applied clamping load across the post 14, thereby protecting the post 14 from damage while still generating the necessary forces discussed above. The clamp block 52 is attached to the screw 40 in a manner that allows the rotation of the screw 40 without corresponding rotation of the clamp block 52. It is presently envisioned to create this interconnection by peening over a dog point 54 on the end of the screw 40 within a countersunk bore 56 in the block 52, whereby the deformation of the dog point 54 is sufficient to loosely captivate the block 52 on the screw 40.

A V-shaped groove 60 may also be incorporated into a face 62 of the clamping block 52 to aid in distributing the clamping force over the post 14. For example, the V-groove 60 may be a simple groove having straight sides with a 90 degree included angle or a compound groove 60 having a bottom section 62 with a 90 degree included angle for gripping the sides of a square post and a top section 64 having a 135 degree included angle for gripping round posts. This groove 60 engages the round post 14 in two locations and a square post 14 along two sides, as shown in FIGS. 5 and 7 respectfully. A relief cut 66 may be included in the bottom of the groove to prevent interference with the corner of a square post.

In order to use the present invention, the clamping mechanism 18 is moved to its disengaged position and the connector 10 is installed about the post 14. As shown in FIG. 9, the connector 10 is capable of excepting posts having a cross-sectional width $\alpha$ that is less than the opening $\gamma$ defined when the clamping mechanism 18 is in the disengaged position. The clamping mechanism 18 is then lightly tightened about the post 14 sufficient to hold the connector 10 in place on the post 14. The clamping mechanism 18 is then backed-off from the post 14 sufficient to allow the conductors 12 to be placed in the corresponding recesses 38 of the connector body 16.

Typically, the connector 10 will be used with crossing conductors **12,12*a*. In order to prevent interference between the conductors 12,12*a*, the first conductor 12 will be placed in the upper recess 38 of the jaw 34 that corresponds to the path of the conductor 12, while the second conductor 12*a* would be placed in the lower recess 38*a* of the other jaw 36**. It will also be possible to use the connector with only one conductor or with parallel conductors without bending the conductor from its original path. When using the connector with a single conductor it may be desirable to use a "dummy" piece of wire or short length of rod within another recess to stabilize the connector by simulating a second conductor.

Once the conductors **12,12*a* are received within the recesses 38,38*a*, the clamping mechanism 18 can be advanced to its engaged position tight against the post 14 which is now held firmly against the conductors 12,12*a* within the body 16 of the connector 10. If a shear head bolt is being used, the first head 46 is tightened, using a conventional wrench, until the first head 46 shears from the tightening screw 40. The installation of the connector 10** is complete.

It will be appreciated that the present invention has significant advantages for connecting conductors of a signal reference grid to a sub-floor support post. It should be recognized that the above-described embodiment constitutes the presently preferred form of the invention and that the invention can take numerous other forms, some of which have been described above, and may be used in other types of applications. Accordingly, the invention should be limited only as required by the scope of the following claims.

I claim:

1. A ground connector for connecting a conductor along a portion of the length of the conductor to a post, comprising:

a body having a first end portion and a second end portion joined by a middle portion, the portions being bounded by generally opposing side surfaces, the first end portion having a seat profiled for receiving the post therein, the seat having a plurality of recesses to receive the portion of the conductor to be connected with the post that are accessible to the portion of the length of the conductor to be received therein from along one of the side surfaces, whereby the portion of the conductor is positioned in one of the recesses without requiring access to an end of the conductor; and a clamping mechanism movable between an engaged position where the post is held tightly in the seat and against the portion of the conductor received within the recess and a disengaged position away from the post where the connector disengages both the post and the conductor.

2. The ground connector of claim 1, wherein the inner surface of the seat has a base jaw and a back-up jaw that define an angle therebetween.

3. The ground connector of claim 2, wherein the clamping mechanism moves along a line that bi-sects the angle between the base jaw and the back-up jaw.

4. The ground connector of claim 1, wherein the clamping mechanism is a clamp tightening screw in communication with a threaded bore at the second end portion of the body.

5. The ground connector of claim 1, wherein the clamping mechanism is further adapted to limit compression of the post against the conductors.

6. The ground connector of claim 4, wherein the clamp tightening screw has a shear-head to provide controlled torque installation.

7. The ground connector of claim 6, wherein the shear-head comprises a first head and a second head separated by an undercut extending into the screw for limiting the amount of force that can be exerted by the clamp tightening screw by tightening the first head.

8. The ground connector of claim 1, wherein the clamping mechanism includes a clamp block having a face adapted to engage the post.

9. The ground connector of claim 8, wherein the face has a V-shaped groove therein extending along the face along the post.

10. The ground connector of claim 9, wherein the V-shaped groove has opposing compound surfaces defining an included angle closest to the bottom of the groove of 90 degrees and an included angle closest to the top of the groove of 135 degrees.

11. A ground connector for connecting crossing conductors along a portion of the length of each conductor to a post; the ground connector comprising:

a body having a first end portion and a second end portion joined by a middle portion, the portions being bounded by generally opposing side surfaces, the first end portion having a seat profiled for receiving the post therein, the seat having a plurality of recesses to receive the portion of each of the crossing conductors that is to be connected to the post, the recesses being accessible to the portion of the length of the conductor to be received therein from along one of the side surfaces, where at least some of the recesses extend along paths that generally correspond to the lengths of the crossing conductors and these corresponding recesses are in different planes transverse to the seated post, whereby each of the portions of the conductors is positioned in a different one of the recesses without requiring access to an end of the conductors and without substantial interference with the other crossing conductor; and a clamping mechanism movable between an engaged position where the post is held tightly in the seat and against the portions of the conductors received within the recesses and a disengaged position away from the post where the connector disengages both the post and the conductors.

12. The ground connector of claim 11, wherein the seat has a base jaw and a back-up jaw defining an angle therebetween and the recesses are disposed in the jaws along a side surface.

13. The ground connector of claim 12, wherein the angle between the jaws corresponds to the angle between the crossing conductors.

14. The ground connector of claim 12, wherein the clamping mechanism moves along a line that bi-sects the angle between the base jaw and the back-up jaw.

15. A ground connector for connecting crossing connectors along a portion of the length of each conductor to a post, comprising:

a body having a first end portion and a second end portion joined by a middle portion, the portions being bounded by generally opposing side surfaces, the first end portion having a seat profiled for receiving the post therein, the seat having multiple sets of corresponding recesses that receive the portions of the conductors to be connected to the post, each set of recesses extending along different planes that are transverse to the seated post and each recess is accessible to the portion of the length of the conductor from along one of the side surfaces, whereby the portion is positioned in one of the recesses without requiring access to an end of the conductor; and a clamping mechanism movable between an engaged position where the post is held tightly in the seat and against the portion of each of the crossing conductors received within their respective recesses and a disengaged position away from the post where the connector disengages both the post and the conductors.

16. The connector of claim 15, wherein there are two sets of recesses, each set being disposed along a different one of the side surfaces.

17. The connector of claim 15, wherein each set of recesses contains recesses disposed along paths that correspond to each of the crossing conductors.

18. The ground connector of claim 15, wherein the clamping mechanism is a clamp tightening screw in communication with a threaded bore at the second end portion of the body.

19. The ground connector of claim 18, wherein the clamp tightening screw has a shear-head to provide controlled torque installation.

* * * * *

UNITED STATES PATENT AND TRADEMARK OFFICE

CERTIFICATE OF CORRECTION

PATENT NO. : 5,286,211

DATED : February 15, 1994

INVENTOR(S) : Glen D. P. McIntosh

It is certified that error appears in the above-identified patent and that said Letters Patent is hereby corrected as shown below:

Col. 8, claim 15, lines 1-2 change "connectors" to --conductors--.

Signed and Sealed this

Fifth Day of July, 1994

Bruce Lehman

*Attest:*

BRUCE LEHMAN

*Attesting Officer*

*Commissioner of Patents and Trademarks*